US010342111B2

(12) United States Patent
Nishikata et al.

(10) Patent No.: US 10,342,111 B2
(45) Date of Patent: Jul. 2, 2019

(54) ELECTROMAGNETIC PULSE PROTECTION METHOD AND ELECTROMAGNETIC PULSE PROTECTION SYSTEM

(71) Applicant: MITSUBISHI HEAVY INDUSTRIES, LTD., Tokyo (JP)

(72) Inventors: Shingo Nishikata, Tokyo (JP); Yoshikatsu Kuroda, Tokyo (JP); Hiroshi Ikebuchi, Tokyo (JP); Koichi Hamamoto, Tokyo (JP); Tomoya Morioka, Tokyo (JP); Atsushi Ochiai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/562,642

(22) PCT Filed: Apr. 14, 2016

(86) PCT No.: PCT/JP2016/062002
§ 371 (c)(1),
(2) Date: Sep. 28, 2017

(87) PCT Pub. No.: WO2017/002428
PCT Pub. Date: Jan. 5, 2017

(65) Prior Publication Data

US 2018/0092195 A1 Mar. 29, 2018

(30) Foreign Application Priority Data

Jun. 30, 2015 (JP) ..... 2015-131626

(51) Int. Cl.
*H05H 1/24* (2006.01)
*F41H 13/00* (2006.01)
*F41H 11/00* (2006.01)

(52) U.S. Cl.
CPC ..... *H05H 1/24* (2013.01); *F41H 11/00* (2013.01); *F41H 13/005* (2013.01); *F41H 13/0093* (2013.01); *H05H 2277/00* (2013.01)

(58) Field of Classification Search
CPC ... H05H 1/24; H05H 2277/00; F41H 13/0093
(Continued)

(56) References Cited

U.S. PATENT DOCUMENTS 5,747,720 A 5/1998 Schnurr et al.
7,255,062 B1 8/2007 Higman
(Continued)

FOREIGN PATENT DOCUMENTS

DE 10 2007 049 436 4/2009
EP 1 746 381 1/2007
(Continued)

OTHER PUBLICATIONS

International Preliminary Report on Patentability dated Nov. 2, 2017 in International Application No. PCT/JP2016/062002.
(Continued)

*Primary Examiner* — Nicole M Ippolito
(74) *Attorney, Agent, or Firm* — Wenderoth, Lind & Ponack, L.L.P.

(57) ABSTRACT

An electromagnetic pulse protecting method includes: searching a threat 2 that generates an electromagnetic pulse 2*a*; and generating plasma 6 in a light-condensed point 4 by condensing a laser beam 5 on a light-condensed point 4 in response to detection of the threat 2. Thus, various protection objects which contain a protection object having an electric opening indispensably can be protected from an attack by the electromagnetic pulse.

15 Claims, 5 Drawing Sheets

(58) Field of Classification Search
USPC ..... 250/493.1, 494.1
See application file for complete search history.

(56) References Cited

U.S. PATENT DOCUMENTS

| | | | |
|---|---|---|---|
| 7,970,023 | B2 | 6/2011 | Protz et al. |
| 8,981,261 | B1 | 3/2015 | Tillotson |
| 9,805,829 | B2 | 10/2017 | Sekine et al. |
| 2001/0011712 | A1 | 8/2001 | Castenmiller et al. |
| 2005/0068999 | A1 | 3/2005 | Momiuchi et al. |
| 2007/0051233 | A1 | 3/2007 | Duge |
| 2007/0144392 | A1 | 6/2007 | Wood et al. |
| 2008/0197299 | A1 | 8/2008 | Hoshino et al. |
| 2009/0084252 | A1 | 4/2009 | Marquis et al. |
| 2009/0097508 | A1 | 4/2009 | Protz et al. |
| 2010/0018428 | A1 | 1/2010 | Regebro |
| 2010/0127191 | A1 | 5/2010 | Partlo et al. |
| 2013/0033695 | A1 | 2/2013 | Kong et al. |
| 2015/0270019 | A1 | 9/2015 | Sekine et al. |
| 2016/0097616 | A1 | 4/2016 | Weigold |
| 2018/0080747 | A1* | 3/2018 | Nishikata ..... F41H 11/02 |

FOREIGN PATENT DOCUMENTS

| | | |
|---|---|---|
| EP | 2 489 399 | 8/2012 |
| EP | 2 911 153 | 8/2015 |
| JP | 5-223499 | 8/1993 |
| JP | 10-59297 | 3/1998 |
| JP | 2000-65497 | 3/2000 |
| JP | 2003-233339 | 8/2003 |
| JP | 2006-226608 | 8/2006 |
| JP | 2007-206588 | 8/2007 |
| JP | 2012-208370 | 10/2012 |
| WO | 2014/061562 | 4/2014 |

OTHER PUBLICATIONS

International Search Report dated Jul. 12, 2016 in International Application No. PCT/JP2016/062002.

Extended European Search Report dated Mar. 14, 2018 in European Patent Application No. 16817538.8.

Extended European Search Report dated Mar. 6, 2018 in European Patent Application No. 16817537.0.

International Search Report dated Jul. 12, 2016 in International Application No. PCT/JP2016/061998.

International Preliminary Report on Patentability dated Jan. 11, 2018 in International Application No. PCT/JP2016/061998.

Koechner et al., "Solid-State Lasers: A Graduate Text", (1993), pp. 127-141.

Office Action dated Nov. 1, 2018 from U.S. Appl. No. 15/564,130 including double patenting rejections on pp. 5-6.

* cited by examiner

ELECTROMAGNETIC PULSE PROTECTION METHOD AND ELECTROMAGNETIC PULSE PROTECTION SYSTEM

TECHNICAL FIELD

The present invention relates to an electromagnetic pulse protection method and an electromagnetic pulse protection system.

BACKGROUND ART

When receiving a strong electromagnetic pulse, electronic equipment cannot operate normally, and in some cases, it is destroyed. EMP (electromagnetic pulse) weapon uses such a phenomenon, in which the strong electromagnetic pulse is generated by any method, and is irradiated to a target to hinder the operation of the electronic equipment or to destroy the electronic equipment.

As a result of the development of the EMP weapon in recent years, it is requested to protect various types of electronic equipment from an attack by such a strong electromagnetic pulse emitted from the EMP weapon. One method for protecting the protection object from the attack by the EMP weapon is a method of covering the whole protection object with a shield formed of an electrically conductive body. However, this method cannot be applied to the protection object such as a radar antenna in which an electric opening is indispensable on the configuration of the apparatus. Also, in a problem of forming the shield, it becomes difficult to prevent the influence of the electromagnetic pulse when a gap is formed in the shield. Also, it is difficult to avoid an adverse influence to the electronic equipment.

From such a background, it is demanded to provide a technique of protecting various protection objects containing a protection object having an electric opening from the attack by the strong electromagnetic pulse.

Note that as the technique in conjunction with the present invention, JP 2007-206588A discloses an aerial visible image forming apparatus that condenses a laser beam to generate plasma, and illustrates a visible image of characters, images and so on the air with visible light outputted from the plasma.

CITATION LIST

[Patent Literature 1] JP 2007-206588A

SUMMARY OF THE INVENTION

Therefore, an object of the present invention is to provide a technique of protecting various protection objects containing a protection object, in which an electric opening is indispensable, from an attack by an electromagnetic pulse.

The other objects and new features of the present invention could be understood from the disclosure of this Description and the drawings.

In one aspect of the present invention an electromagnetic pulse protecting method includes: searching a threat which generates an electromagnetic pulse; and generating plasma in a light-condensed point by condensing a laser beam on the light-condensed point in response to detection of the threat.

In one embodiment, the plasma is generated in each of a plurality of light-condensed points by condensing the laser beam on each of the plurality of light-condensed points. By generating the plasma in each of the plurality of the light-condensed points, the plasma is generated between a protection object to be protected from the electromagnetism pulse, thereby protecting the protection object from the electromagnetism pulse generated from the threat.

In one embodiment, the laser beams generated by a plurality of laser devices may be condensed on the light-condensed point.

In another embodiment, the laser beams generated by a plurality of laser devices may be condensed on one of the plurality of light-condensed points.

It is desirable that the laser beam is a pulse laser beam generated by a pulse laser that carries out pulse oscillation.

It is desirable that the position of light-condensed point is set based on the position of the threat. In one embodiment, the position of light-condensed point is set between the position of the protection object to be protected from the electromagnetic pulse and the position of the threat.

In another aspect of the present invention, an electromagnetic pulse protecting system includes: a threat detecting apparatus configured to search a threat that generates an electromagnetic pulse; and a laser system configured to condense a laser beam on a light-condensed point in response to detection of the threat by the threat detecting apparatus, to generate plasma in the light-condensed point.

In one embodiment, the laser system includes a plurality of laser devices that generates the laser beams. In this case, it is desirable that the laser system is configured such that the laser beams generated from the plurality of laser devices are condensed on the plurality of light-condensed points, respectively, to generate plasma in each of the plurality of light-condensed points.

In one embodiment, the laser system may be configured such that the laser beams generated by the plurality of laser devices are condensed on the light-condensed point. The laser beams generated from the plurality of laser devices may be condensed on one of the plurality of light-condensed points.

In one embodiment, the laser system desirably generates the laser beam through pulse oscillation.

Also, it is desirable that the laser system sets a position of light-condensed point based on the position of the threat. In one embodiment, the position of light-condensed point is set between the protection object to be protected from the electromagnetic pulse and the threat.

According to the present invention, the various protection objects can be protected from the attack by the electromagnetic pulse.

DESCRIPTION OF THE EMBODIMENTS

First Embodiment

Figure 1:
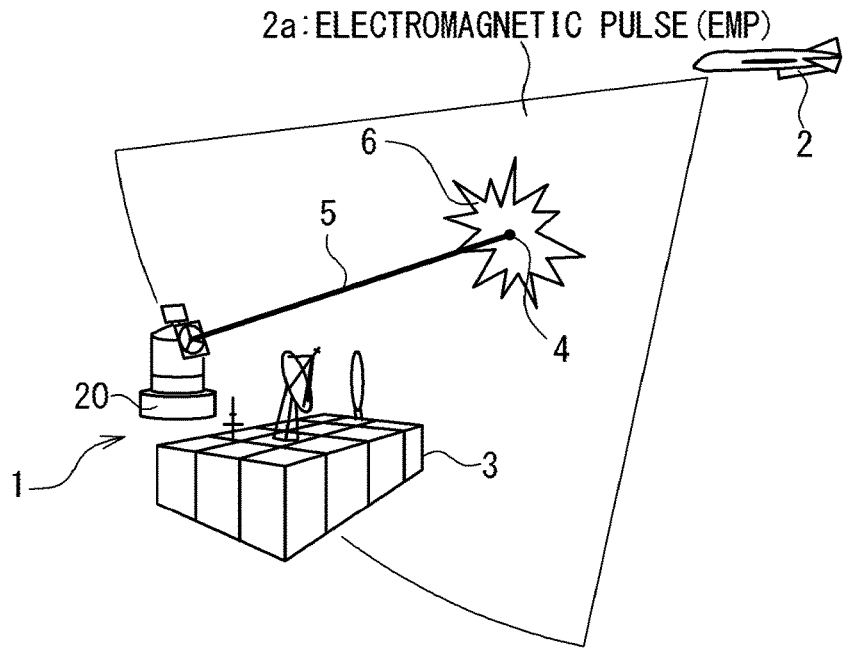
FIG. 1 is a conceptual diagram showing an example of an electromagnetic pulse protection system according to a first embodiment.

FIG. 1 is a conceptual diagram showing an example of an electromagnetic pulse protection system 1 according to a first embodiment of the present invention. When a threat 2 having attack capability by a strong electromagnetic pulse (EMP) is determined to be approaching a protection object 3, the electromagnetic pulse protection system 1 in the present embodiment protects the protection object 3 from the electromagnetic pulse 2*a* irradiated from the threat 2. For example, as the threat 2, an EMP weapon loaded into a flying object such as an aircraft and a missile is raised. As described below in detail, the electromagnetic pulse protection system 1 in the present embodiment generates plasma 6 in a light-condensed point 4 by condensing a laser beam 5 on the light-condensed point 4, and protects the protection object 3 from the electromagnetic pulse 2*a* irradiated from the threat 2 by using the generated plasma 6. Since the plasma has the nature of reflecting electromagnetic wave having a lower frequency than a plasma frequency, the protection object 3 can be protected from the electromagnetic pulse 2*a* by generating the plasma 6 in an appropriate position.

Figure 2:
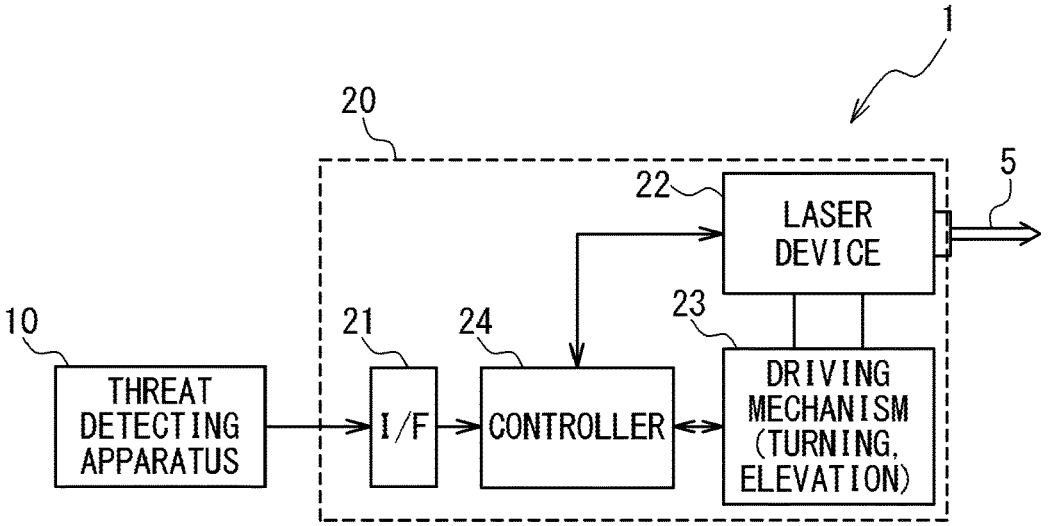
FIG. 2 is a block diagram showing an example of configuration of the electromagnetic pulse protection system in the first embodiment.

FIG. 2 is a block diagram showing an example of configuration of the electromagnetic pulse protection system 1 in the present embodiment. The electromagnetic pulse protection system 1 in the present embodiment includes a threat detecting apparatus 10 and a laser system 20. The threat detecting apparatus 10 is an apparatus that searches the threat 2, and specifies the position of the threat 2. When detecting the threat 2, the threat detecting apparatus 10 transmits to the laser system 20, data of the threat 2, e.g. threat detection data showing the position, the speed, the direction, the altitude and so on. In one embodiment, a laser radar can be used as the threat detecting apparatus 10.

The laser system 20 is configured to set the light-condensed point 4 based on the threat detection data received from the threat detecting apparatus 10, and to condense the laser beam 5 on the set light-condensed point 4. In detail, the laser system 20 includes an interface 21, the laser device 22, a driving mechanism 23 and a controller 24.

The interface 21 receives the threat detection data from the threat detecting apparatus 10 and transfers it to the controller 24.

The laser device 22 generates the laser beam 5. In the present embodiment, the laser device 22 is configured as a pulse laser that carries out a pulse oscillation. The generated laser beam 5 is a pulse laser beam. The reason why the pulse laser is used as the laser device 22 is in that the generation of the plasma in the light-condensed point 4 is easy. As mentioned above, the electromagnetic pulse protection system 1 in the present embodiment adopts the configuration to generate the plasma 6 in the light-condensed point 4, and to protect the protection object 3 from the electromagnetic pulse by the plasma 6. To generate the plasma 6 in the light-condensed point 4, it is enough to increase the electric field strength in the light-condensed point 4 to an extent stronger than breakdown electric field strength in the atmosphere. The pulse laser is suitable for a high peak output of the laser beam, i.e. a spontaneous increase of the electric field strength. Therefore, it is desirable to use the pulse laser as the laser device 22 for the generation of plasma. As the laser device 22, for example, the pulse laser can be used to generate the pulse laser beam having the laser wavelength of 1.06 μm, the pulse duration of 10 ns and the pulse energy of 100 J. Note that if it is possible to generate the plasma, a laser of a continuation wave oscillation type may be used as the laser device 22. In this case, the laser beam of the continuation wave laser is generated as the laser beam 5.

The driving mechanism 23 is a mechanism to drive the laser device 22 such that the direction of the optical axis of the laser device 22 turns to a desired direction (that is, the direction to which the laser beam 5 is emitted). The driving mechanism 23 controls the direction of the laser device 22 such that an elevation angle (an angle between a horizontal plane and an optical axis) and a rotation angle (an angle between a predetermined direction on the horizontal plane and the projection of the optical axis onto the horizontal plane) become equal to command values given from the controller 24.

The controller 24 controls the laser device 22 and the driving mechanism 23 such that the laser beam 5 is condensed on the light-condensed point 4 of a desired position. In detail, the controller 24 sets the position of light-condensed point 4 based on the threat detection data received from the threat detecting apparatus 10. Moreover, the controller 24 controls the driving mechanism 23 such that the laser beam 5 is emitted toward the light-condensed point 4 (that is, the optical axis of the laser device 22 passes through the light-condensed point 4). Also, the controller 24 controls the focal length of the laser device 22 (the focal length of the optical system of the laser device 22) so as to condense the laser beam 5 on the light-condensed point 4.

Figure 3:
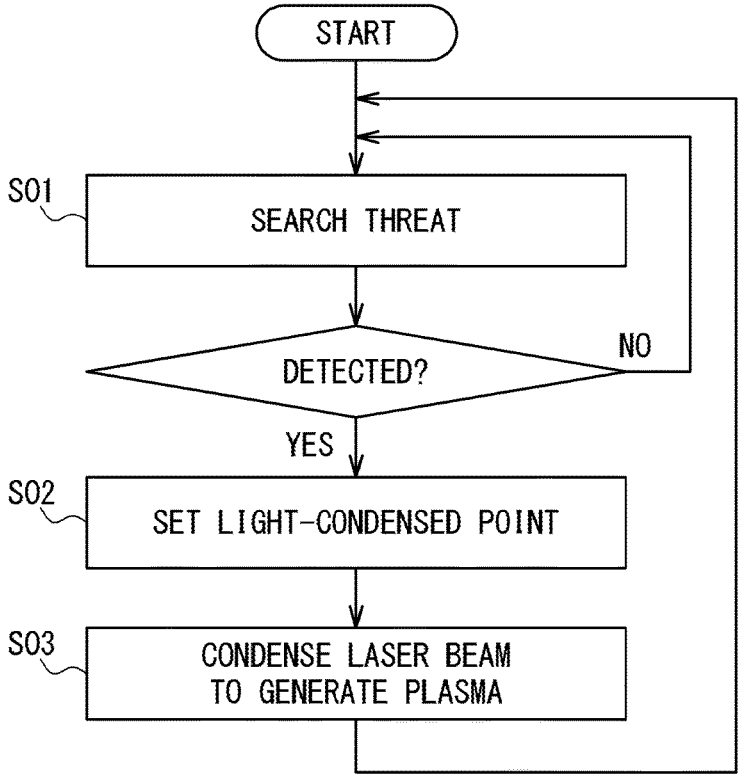
FIG. 3 is a flow chart showing an example of operation of the electromagnetic pulse protection system in the first embodiment.

FIG. 3 is a flow chart showing an example of operation of the electromagnetic pulse protection system 1 in the present embodiment. The search of the threat 2 in a predetermined warning region (for example, a region that contains the protection object 3) is carried out by the threat detecting apparatus 10 (Step S01). When detecting the threat 2 through the search, the threat detecting apparatus 10 transmits data of the threat 2, e.g. the threat detection data showing the position, the speed and so on of the threat 2, to the laser system 20.

Moreover, the position of light-condensed point 4 is set by the controller 24 of the laser system 20 (Step S02). The setting of the position of light-condensed point 4 is carried out based on the threat detection data. In the present embodiment, the position of light-condensed point 4 is set based on the position of the threat 2 shown in the threat detection data. In one embodiment, the light-condensed point 4 may be set to a position between the threat 2 and the protection object 3 by referring to the threat detection data. Also, in another embodiment, a prediction position of the threat 2 when the laser beam 5 be emitted is calculated based on the position, the speed, the direction, the altitude and so on of the threat 2 shown in the threat detection data. The light-condensed point 4 may be set to a position between the calculated prediction position and the protection object 3.

Moreover, the laser beam 5 is irradiated to be condensed on the light-condensed point 4 (Step S03). In detail, the direction of the optical axis of the laser device 22 is controlled by the driving mechanism 23 such that the laser beam 5 passes through the light-condensed point 4, and the focal length of the laser device 22 is controlled. When the control direction of the optical axis of the laser device 22 and the control of the focal length are completed, the laser device 22 irradiates the laser beam 5 under the control by the controller 24.

When the laser beam 5 is condensed on the light-condensed point 4 so that the electric field strength in the light-condensed point 4 exceeds the breakdown electric field strength in the atmosphere, the plasma 6 is generated in the light-condensed point 4. Like mentioned above, when the pulse laser beam generated through the pulse oscillation is used as the laser beam 5, the generation of plasma 6 becomes easy. Since the plasma has the nature of reflecting electromagnetic wave that has a frequency lower than a plasma frequency, the plasma 6 generated by the laser beam 5 functions as an electromagnetic shield to the electromagnetic pulse generated by the threat 2. Therefore, the protection object 3 can be protected from the electromagnetic pulse 2*a* generated by the threat 2.

The search of the threat 2 continues to be carried out as long as the electromagnetic pulse protection system 1 operates. The setting of the position of light-condensed point 4 and the irradiating of the laser beam 5 are carried out in response to the detection of threat 2 (for example, every time the threat 2 is detected).

In the above-mentioned operation, the position of light-condensed point 4 is determined based on the position of the threat 2. However, the position of light-condensed point 4 may be previously determined irrespective of the position of the threat 2. In this case, the laser beam 5 is condensed on the light-condensed point 4 of the previously determined position.

One of the advantages of the electromagnetic pulse protection system 1 in the present embodiment is in that various protection objects can be protected from the attack by the electromagnetic pulse. The electromagnetic pulse protection system 1 in the present embodiment that uses the plasma for the electromagnetic shield is not necessary to cover the whole protection object 3 with a shield material formed of an electrically conductive body. Therefore, the electromagnetic pulse protection system 1 in the present embodiment can be applied even when the protection object 3 is such as a radar antenna having an electric opening indispensably on the configuration of apparatus. Additionally, the electromagnetic pulse protection system 1 in the present embodiment can protect the protection object 3 in a low cost even when the protection object 3 is large-scaled.

Second Embodiment

Figure 4:
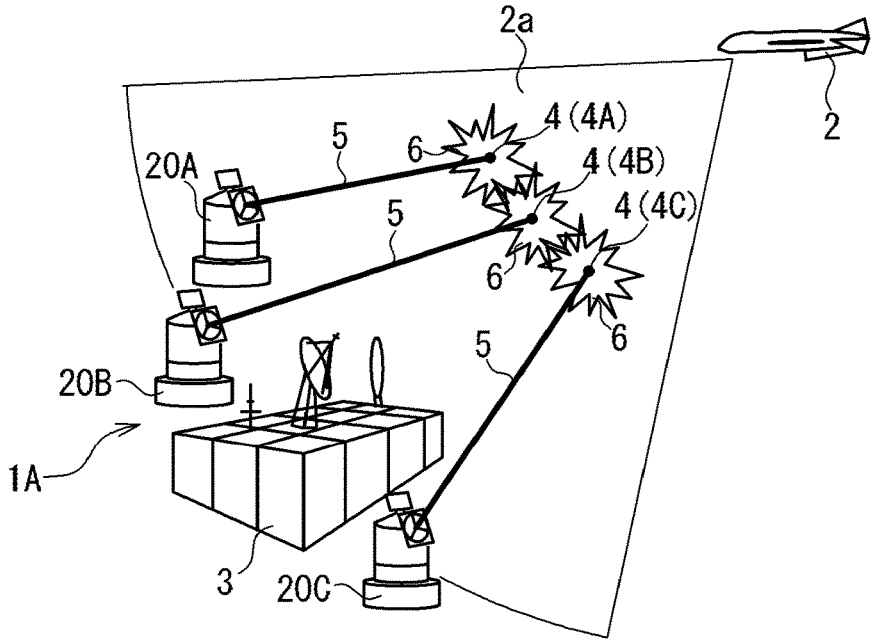
FIG. 4 is a conceptual diagram showing an example of the electromagnetic pulse protection system according to a second embodiment.

FIG. 4 is a conceptual diagram showing an example of the electromagnetic pulse protection system 1A according to a second embodiment. The electromagnetic pulse protection system 1A in the second embodiment is configured to have a plurality of laser devices, and condense the laser beams 5 generated by the plurality of laser devices on a plurality of light-condensed points 4, respectively. According to such a configuration, since the plasma 6 can be generated in a wide region, the protection object 3 can be protected more surely from the electromagnetic pulse.

Figure 5:
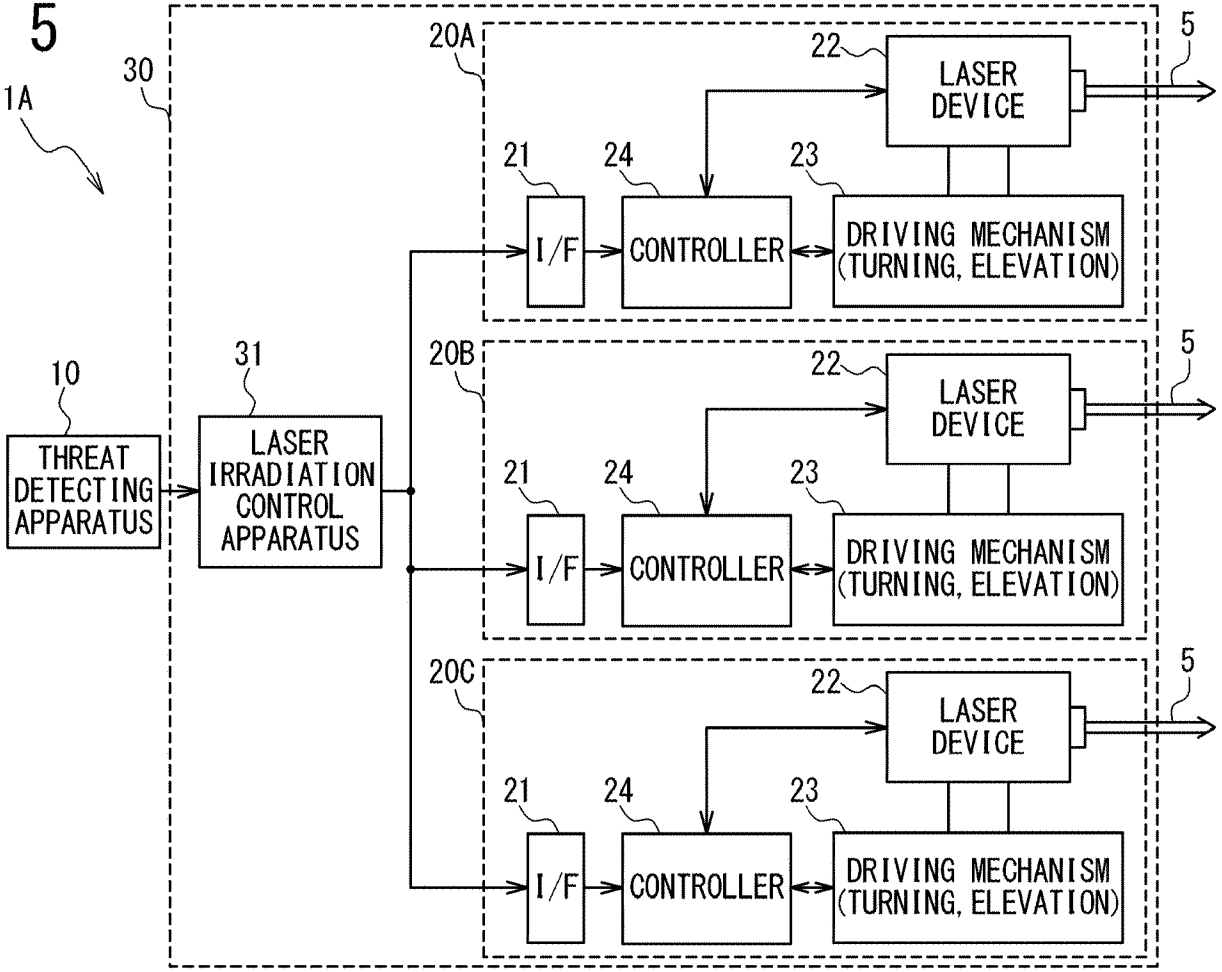
FIG. 5 is a block diagram showing an example of configuration of the electromagnetic pulse protection system in the second embodiment

FIG. 5 is a block diagram showing an example of configuration of the electromagnetic pulse protection system 1A in the second embodiment. The electromagnetic pulse protection system 1A in the present embodiment includes the threat detecting apparatus 10 and a laser system 30. The threat detecting apparatus 10 searches the threat 2. When detecting the threat 2 through the search, the electromagnetic pulse protection system 1A transmits data of the threat 2, e.g. the threat detection data showing the position, the speed and so on, to the laser system 30. For example, a laser radar may be used as the threat detecting apparatus 10.

The laser system 30 sets a plurality of light-condensed points 4 according to the threat detection data received from the threat detecting apparatus 10. Moreover, the laser system 30 is configured to condense the laser beams 5 on the plurality of light-condensed points 4, respectively. In detail, the laser system 30 includes a laser irradiation control apparatus 31, and a plurality of subsystems 20A to 20C.

Figure 6:
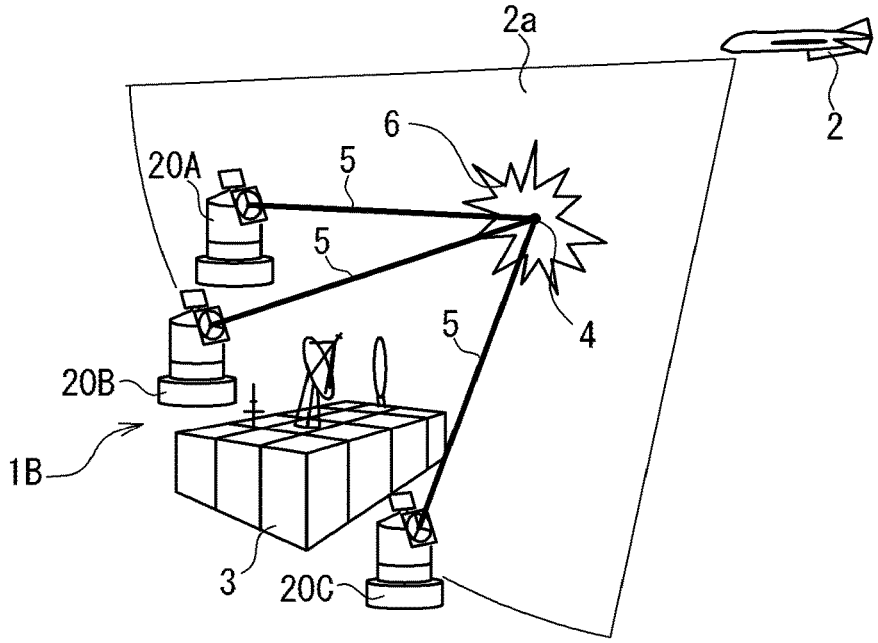
FIG. 6 is a conceptual diagram showing an example of the electromagnetic pulse protection system according to a third embodiment.

The laser irradiation control apparatus 31 sets the plurality of light-condensed points 4 according to the threat detection data received from the threat detecting apparatus 10. Moreover, the laser irradiation control apparatus 31 transmits a laser irradiation instruction to instruct each of the subsystems 20A to 20C to irradiate the laser beam 5 so as to condense the laser beam 5 on a corresponding one of the plurality of light-condensed points 4. In FIG. 6, the light-condensed points 4 specified for the subsystems 20A, 20B and 20C are shown by 4A, 4B, and 4C, respectively. The each of the subsystems 20A, 20B and 20C irradiates the laser beam 5 in response to the laser irradiation instruction transmitted to each of the subsystems so as for the laser beam to be condensed on a corresponding one of the light-condensed points 4A, 4B, and 4C.

Each of the subsystems 20A to 20C has the same configuration as the laser system 20 in the first embodiment. More specifically, each of the subsystems 20A to 20C has the interface 21, the laser device 22, the driving mechanism 23 and the controller 24.

The interface 21 receives the laser irradiation instruction from the laser irradiation control apparatus 31 and transfers it to the controller 24. The laser device 22 generates the laser beam 5 to be condensed on the light-condensed point 4. Like the first embodiment, the laser device 22 is configured as a pulse laser that carries out pulse oscillation. The driving mechanism 23 drives the laser device 22 to turn the optical axis of the laser device 22 to a desired direction (that is, the direction to which the laser beam 5 is irradiated). The controller 24 controls the laser device 22 and the driving mechanism 23 such that the laser beam 5 is condensed on the light-condensed point 4 in the position instructed by the laser irradiation instruction. The controller 24 controls the driving mechanism 23 to turn the optical axis of the laser device 22 to a direction in which the laser beam 5 passes through the light-condensed point 4 and moreover controls the focal length of the laser device 22.

The operation of the electromagnetic pulse protection system 1A in the second embodiment is the same as that of the electromagnetic pulse protection system 1 in the first embodiment, excluding that the laser beams 5 irradiated from the plurality of laser devices 22 are condensed on the specified light-condensed points 4.

More specifically, the search of the threat 2 in the predetermined warning region (for example, the region that contains the protection object 3) is carried out by the threat detecting apparatus 10. When the threat 2 is detected through the search, the threat detection data is transmitted to the laser system 30 from the threat detecting apparatus 10.

Moreover, the plurality of positions of light-condensed points 4 are set by the laser irradiation control apparatus 31. The plurality of light-condensed points 4 may be set to be different from each other in the position. As mentioned above, this is because the region where the plasma 6 is generated is expanded to protect the protection object 3 from the electromagnetic pulse more surely. By expanding the region where the plasma 6 is generated, the electromagnetic pulse can be reflected in a wide region, and it becomes difficult for the electromagnetic pulse to reach the protection object 3 from the threat 2.

In the present embodiment, the setting of the positions of light-condensed points 4 is carried out based on the threat detection data. In one embodiment, the light-condensed points 4 may be set to the plurality of positions between the threat 2 and the protection object 3, by referring to the threat detection data. Or, in another embodiment, the prediction position of the threat 2 at a time when the laser beam 5 is to be irradiated may be calculated based on the position, the speed, the direction, the altitude and so on of the threat 2 shown in the threat detection data, and the positions of light-condensed points 4 may be set between the calculated prediction position and the protection object 3. The laser irradiation control apparatus 31 transmits the laser irradiation instruction to the subsystems 20A to 20C to instruct each of them to irradiate the laser beam 5 such that the laser beams 5 are condensed on the set light-condensed points 4.

Moreover, the laser beams 5 are irradiated from the subsystems 20A to 20C to be condensed on the corresponding light-condensed points 4. Each of the subsystems 20A to 20C irradiates the laser beam 5 to be condensed on the light-condensed point 4 specified by the laser irradiation instruction transmitted thereto. In each of the subsystems 20A to 20C, the optical axis of the laser device 22 is driven by the driving mechanism 23 for the laser beam 5 to pass through the light-condensed point 4. Moreover, the focal length of the laser device 22 is controlled. When the direction control of the optical axis of the laser device 22 and the control of the focal length are completed, the laser device 22 irradiates the laser beam 5.

The laser beam 5 is condensed on a corresponding one of the light-condensed points 4, and when the electric field strength in the corresponding light-condensed point 4 exceeds breakdown electric field strength in the atmosphere, the plasma 6 is generated in the corresponding light-condensed point 4. Since the plasma 6 has the nature of reflecting the electromagnetic wave having a frequency lower than a plasma frequency. Therefore, the plasma 6 generated by the laser beam 5 functions as an electromagnetic shield to the electromagnetic pulse. Therefore, the protection object 3 can be protected from the electromagnetic pulse 2*a* generated from the threat 2.

Note that in the above-mentioned operation, the position of light-condensed point 4 is determined based on the position of the threat 2. However, the position of light-condensed point 4 may be previously determined irrespective of the position of threat 2. In this case, the laser beam 5 is condensed on the light-condensed point 4 of previously determined position.

The electromagnetic pulse protection system 1A in the second embodiment can protect various protection objects from an attack by the strong electromagnetic pulse, like the electromagnetic pulse protection system in the first embodiment. The electromagnetic pulse protection system 1 in the present embodiment that uses the plasma for the electromagnetic shield is not necessary to cover the whole protection object 3 with the shield formed of an electric conductive body, and is suitable for protection of the protection object 3 (for example, a radar antenna) having an electric opening and a large-scaled protection object 3.

Additionally, in the second embodiment, the plurality of laser devices 22 (i.e. a plurality of subsystems) are provided, and a plurality of light-condensed points 4 respectively corresponding to the devices 22 are set. Thus, the region where the plasma 6 is generated is expanded, to make it possible to protect the protection object 3 from the electromagnetic pulse more surely.

Third Embodiment

FIG. 6 is a conceptual diagram showing an example of an electromagnetic pulse protection system 1B according to a third embodiment of the present invention. The configuration of the electromagnetic pulse protection system 1B in the third embodiment is identical with that of the electromagnetic pulse protection system 1A in the second embodiment (reference to FIG. 5). However, the electromagnetic pulse protection system 1B in the third embodiment is different in that the laser beams 5 generated by the plurality of laser devices are condensed on a single light-condensed point 4. FIG. 6 shows that the laser beams 5 generated by the laser devices 22 of the three subsystems 20A to 20C are condensed on a single light-condensed point 4.

More specifically, the search of the threat 2 in a predetermined warning region (for example, region which contains the protection object 3) is carried out by the threat detecting apparatus 10, and when the threat 2 is detected through the search, the threat detection data is transmitted to the laser systems 30 from the threat detecting apparatus 10.

Moreover, the position of light-condensed point 4 is set by the laser irradiation control apparatus 31. The setting of the position of light-condensed point 4 is carried out based on the threat detection data. In the present embodiment, the position of light-condensed point 4 is set based on the position of the threat 2 specified in the threat detection data. In one embodiment, the light-condensed point 4 may be set to a position between the threat 2 and the protection object 3 by referring to the threat detection data. In another embodiment, a prediction position of the threat 2 at a time point when the laser beam 5 is to be emitted may be calculated based on the position, the speed, the direction, the altitude and so on of the threat 2 specified in the threat detection data, and the light-condensed point 4 may be set to a position between the calculated prediction position and the protection object 3. The laser irradiation control apparatus 31 transmits the laser irradiation instruction to each of the subsystems 20A to 20C to instruct each subsystem to irradiate the laser beam 5 such that the laser beam 5 is condensed on the position of set light-condensed point 4.

Moreover, the subsystems 20A to 20C irradiate the laser beams 5 to be condensed on the light-condensed point 4. Each of the subsystems 20A to 20C irradiates the laser beam 5 such that the laser beams are condensed on the light-condensed point 4 specified by the laser irradiation instruction. The driving mechanism 23 drives each of the subsystems 20A to 20C so as to control the optical axis of the laser device 22 so that the laser beam 5 passes through the light-condensed point 4. Moreover, the focal length of the laser device 22 is controlled. When the direction control of the optical axis of the laser device 22 and the control of the focal length are completed, the laser device 22 irradiates the laser beam 5.

The laser beam 5 is condensed on the light-condensed point 4, and when the electric field strength in the light-condensed point 4 exceeds breakdown electric field strength in the atmosphere, the plasma 6 is generated in the light-condensed point 4. Since the plasma has the nature of reflecting the electromagnetic wave with a frequency lower than a plasma frequency, the plasma 6 generated by the laser beam 5 functions as the electromagnetic shield to the electromagnetic pulse. Therefore, the protection object 3 can be protected from the electromagnetic pulse 2*a* generated from the threat 2.

Note that in the above-mentioned operation, the position of light-condensed point 4 may be determined based on the position of the threat 2. However, the position of light-condensed point 4 may be previously determined irrespective of the position of the threat 2. In this case, the laser beam 5 is condensed on the light-condensed point 4 of the previously determined position.

The electromagnetic pulse protection system 1B in the third embodiment can protect various protection objects from the attack by the strong electromagnetic pulse, like the electromagnetic pulse protection systems 1 and 1A in the first and second embodiment. The electromagnetic pulse protection system 1B in the present embodiment that uses the plasma for the electromagnetic shield is not necessary to cover the whole protection object 3 by the shield formed of the electrically conductive body, and is suitable for the protection of the protection object 3 (for example, a radar antenna) having an electric opening and the large-scaled protection object 3.

In addition, the electromagnetic pulse protection system 1B in the third embodiment in which the laser beams 5 generated from the plurality of laser devices 22 are condensed on the light-condensed point 4 is suitable for the miniaturization of each laser device 22. In the electromagnetic pulse protection system 1B in the present embodiment, since the laser beams 5 generated from the plurality of laser devices 22 are condensed on the light-condensed point 4, it is possible to make the output of each laser beam 5 small. This means that it is possible to miniaturize each laser device 22. By miniaturizing each laser device 22, each of the subsystems 20A to 20C can be loaded on a moving vehicle (e.g. an automobile and a ship). This contributes to the improvement of operability.

Viewing from the different viewpoint, the electromagnetic pulse protection system 1B in the third embodiment is suitable for the generation of plasma 6 of a large output. The electromagnetic pulse protection system 1B in the present embodiment that uses the plurality of laser devices 22 can generate the plasma 6 of a large output by increasing the number of laser devices 22 and/or increasing the output of each laser device 22.

Note that a plurality of light-condensed points 4 may be set like the second embodiment, and the laser beams 5 generated from the plurality of laser devices 22 may be condensed on at least one light-condensed point 4 (most desirably, respectively, on the plurality of light-condensed points 4). Thus, while generating the plasma 6 in a wide region, it is possible to reduce the output of each laser device 22 (or, to generate the plasma 6 of a large output). Such a technique can be adopted when the number of laser devices 22 is more than the number of light-condensed points 4.

As mentioned above, the embodiments of the present invention have been variously described. However, the present invention should not be interpreted as being limited to the above-mentioned embodiments. It would be apparent to the skilled person that the present invention can be implemented various changes or modifications.

The invention claimed is:

1. An electromagnetic pulse protecting method comprising:

searching for a threat in atmosphere, the threat generating an electromagnetic pulse; and irradiating a laser beam to have an electric field strength more than a breakdown electric field strength in the atmosphere when the laser beam is condensed on a light-condensed point to result in generating plasma in the light-condensed point in response to detection of the threat.

2. The electromagnetic pulse protecting method according to claim 1, wherein the generating plasma comprises:

generating the plasma in each of a plurality of the light-condensed points by condensing the laser beam on each of the plurality of light-condensed points.

3. The electromagnetic pulse protecting method according to claim 2, wherein the generating the plasma in each of the plurality of light-condensed points comprises:

generating the plasma between a protection object to be protected from the electromagnetism pulse and the threat to shield the protection object from the electromagnetism pulse generated from the threat.

4. The electromagnetic pulse protecting method according to claim 1, wherein the generating plasma comprises:

condensing a plurality of the laser beams generated from a plurality of laser devices on the light-condensed point.

5. The electromagnetic pulse protection method according to claim 1, wherein the condensing comprises:

condensing a plurality of the laser beams generated from a plurality of laser devices on one of a plurality of the light-condensed points, respectively.

6. The electromagnetic pulse protection method according to claim 1, further comprising:

generating the laser beam from a pulse laser that carries out pulse oscillation.

7. The electromagnetic pulse protecting method according to claim 1, further comprising:

determining the position of light-condensed point based on the position of threat.

8. The electromagnetic pulse protecting method according to claim 7, wherein the determining comprises:

setting a position of light-condensed point between the position of the protection object to be protected from the electromagnetism pulse and the position of the threat.

9. An electromagnetic pulse protecting system comprising:

a threat detecting apparatus configured to search for a threat in atmosphere, the threat generating an electromagnetic pulse; and a laser system configured to irradiate a laser beam to have an electric field strength more than a breakdown electric field strength in the atmosphere when the laser beam is condensed by the laser system on a light-condensed point in response to detection of the threat by the threat detecting apparatus, to generate plasma in the light-condensed point.

10. The electromagnetic pulse protecting system according to claim 9, wherein the laser system comprises:

a plurality of laser devices, each of which generates the laser beam, wherein the laser system condenses the laser beams generated from the plurality of laser devices on one a plurality of the light-condensed points, so as to generate the plasma in each of the plurality of light-condensed points.

11. The electromagnetic pulse protecting system according to claim 9, wherein the laser system comprises:

a plurality of laser devices, each of which generates the laser beam, and wherein the laser system condenses the laser beams generated from the plurality of laser devices on the light-condensed point.

12. The electromagnetic pulse protection system according to claim 10, wherein the laser beams generated from plural ones of the plurality of laser devices are condensed on one of the plurality of light-condensed points.

13. The electromagnetic pulse protecting system according to claim 9, wherein the laser system generates the laser beam by carrying out pulse oscillation.

14. The electromagnetic pulse protecting system according to claim 9, wherein the laser system sets the position of light-condensed point based on a position of the threat.

15. The electromagnetic pulse protecting system according to claim 14, wherein the position of light-condensed point is set to a position between the protection object to be protected from the electromagnetism pulse and the position of the threat.

* * * * *